US006378752B1

(12) United States Patent
Gaudron

(10) Patent No.: US 6,378,752 B1
(45) Date of Patent: Apr. 30, 2002

(54) AUTOMATICALLY RESETTING COMBUSTION TOOL WITH DEVICE FOR ADVANCING CHARGES THEREIN

(76) Inventor: Paul Gaudron, Powers Fasteners, Power Square, New Rochelle, NY (US) 10801-4495

( * ) Notice: Subject to any disclaimer, the term of this patent is extended or adjusted under 35 U.S.C. 154(b) by 80 days.

(21) Appl. No.: 09/588,890

(22) Filed: Jun. 7, 2000

Related U.S. Application Data

(63) Continuation-in-part of application No. 09/322,543, filed on May 28, 1999, now abandoned, and a continuation-in-part of application No. 09/351,899, filed on Jul. 13, 1999.

(51) Int. Cl.[7] ..... B25C 1/14
(52) U.S. Cl. ..... 227/10; 89/33.01
(58) Field of Search ..... 227/9, 10, 11; 60/632, 635, 638; 89/33.01

(56) References Cited

U.S. PATENT DOCUMENTS

| | | | | | |
|---|---|---|---|---|---|
| 3,066,302 | A | | 12/1962 | De Caro et al. | |
| 3,915,242 | A | | 10/1975 | Bell | |
| 3,991,925 | A | | 11/1976 | Buchel | |
| 4,056,935 | A | | 11/1977 | Gassman | |
| 4,068,790 | A | | 1/1978 | Osterle et al. | |
| 4,252,259 | A | | 2/1981 | Brosius | |
| RE30,617 | E | | 5/1981 | Butler et al. | |
| 4,364,506 | A | | 12/1982 | Schneider | |
| 4,487,353 | A | | 12/1984 | Benson et al. | |
| 4,804,127 | A | | 2/1989 | Kirkman | |
| 4,821,938 | A | | 4/1989 | Haytayan | |
| 5,429,291 | A | * | 7/1995 | Thompson | 227/10 |
| 5,992,723 | A | * | 11/1999 | Lee | 227/10 |
| 6,015,078 | A | * | 1/2000 | Almeras et al. | 227/10 |
| 6,053,388 | A | * | 4/2000 | Pfister et al. | 227/10 |

* cited by examiner

*Primary Examiner*—Scott A. Smith
(74) *Attorney, Agent, or Firm*—Morgan, Lewis & Bockius LLP

(57) ABSTRACT

A powder actuated tool for driving a faster with combustion gases has an automatic reset. To use the device, the operator presses the device to the articles to be fastened, which requires overcoming the force of a spring in order to bring the working end where the fastener exits closer to the piston that rams the fastener. When the device is fired, a charge releases combustion gases into a chamber, whereupon a piston in the chamber is rammed into the head of a fastener to be driven. After the device is fired, the operator releases the pressure, whereupon the spring releases the energy imparted by the operator and resets the device. The reset requires bringing the piston back into contact with the end of the combustion chamber from which the combustion gases entered; the reset is accomplished by a combination of a spring, which brings the chamber forward, and a stop in a fixed position with respect to a housing, which catches the piston and holds it in place until it is effectively driven back into the combustion chamber where it started. The device also has a lever for automatically advancing a strip of charges, the lever being positioned orthogonally skew from the bore in which the ram is disposed and having separate ends for reseting the lever and for advancing the strip of charges, both ends disposed on the same side of the bore axis.

12 Claims, 7 Drawing Sheets

AUTOMATICALLY RESETTING COMBUSTION TOOL WITH DEVICE FOR ADVANCING CHARGES THEREIN

This application is a continuation-in-part of application Ser. No. 09/322,543, filed on May 28, 1999, now abandoned, and a continuation-in-part of application Ser. No. 09/351,899, filed on Jul. 13, 1999, pending.

FIELD OF THE INVENTION

The present invention relates to improvements in portable combustion-powered tools, also called powder-actuated tools because of the use of combustible powder charges, and specifically to such a tool having a resetting mechanism that automatically resets the device to the pre-firing configuration and a device for advancing the charges.

BACKGROUND OF THE INVENTION

Portable combustion-powered tools for use in driving fasteners into workpieces are known and described in the literature. Generally, such devices have the outward geometry of a pistol or gun with a combustion chamber, an explosive charge in the chamber, a fastener that is to be driven when the charge explodes, a piston separating the charge from the fastener, and a handle or grip with a trigger for actuating explosion of the charge.

Upon the pulling of a trigger switch, ignition of a charge creates gas in the combustion chamber, which pushes the piston so as to impact the positioned fastener and drive it into the workpiece. The piston is returned to its original or "ready" position by manually resetting the piston and chamber. Fasteners are positioned in a nosepiece where they are held in a properly positioned orientation for receiving the impact of the piston.

In use, the more fasteners that can be driven in a given time usually means that the construction will progress faster to completion. Powder activated technology (PAT) tools typically have a safety mechanism to assure that the device is firmly abutting the surface into which the fastener is to be driven because of the danger of firing the fastener like a bullet; these safeties prevent firing the device except under certain circumstances. However, on these devices the chamber by which the fastener is driven must be reset, and on such devices the reset is performed manually. Although manually resetting can require only a few seconds, it interrupts the fluidity of the construction process. If manual resetting were to be replaced by an automated resetting, the time for driving the fasteners can be significantly reduced.

Analogous devices that are hydraulically or pneumatically operated incorporate automatic reset mechanisms that utilize the same hydraulic or pneumatic pressure that drives the fastener to reset the device. Unfortunately, there is a need for an analogous mechanism for powder-actuated technology tools. Typically, PAT tools are reset manually by grasping the nose of the device where the fastener is loaded and pulling it away from the chamber (i.e., lengthening the device) to reset the piston; for devices in which the charge is provided as a magazine (e.g., an auto-loading strip of charges), this manual reset also advances the magazine.

In addition, the charges in such powder-actuated devices are typically secured or integrated onto a strip, similar to a belt of bullets for a machine gun, but stiffer. The strip with charges is advanced by a lever mechanism that engages the strip on one end and the piston (or a piston guide or similar structure) on the other end. The mechanism for advancing the strip of charges typically includes a lever that not only pivots about a point, but often wobbles about the pivot. This wobble, or misalignment, can cause the mechanism advancing the strip to fail to advance the strip and, sometimes, actually causes the strip to move in the wrong direction, thus disposing a used charge where a fresh charge should be disposed.

SUMMARY AND OBJECTS OF THE INVENTION

One object of this invention is to provide a portable powder-actuated tool that resets automatically after the fastener is driven. The automatic resetting preferrably resets the chamber, and loads another charge from a magazine. In other embodiments, a magazine of fasteners is also provided and the automatic resetting also loads another fastener from the magazine.

In summary, the device comprises a housing having a bore through a longitudinal axis with an open end, piston disposed in the bore, an annular liner having a longitudinal axis coextensive with that of the bore in the housing and engaging the housing where the bore opens, a nose attached to the liner for accepting and retaining a fastener to be driving by the piston, a stop for limiting movement of the piston towards the open end of the bore in the housing, and a spring biasing the housing and nose apart along their coextensive longitudinal axes.

In operation, when the device is charged and in the "ready" position with a charge in the chamber and a fastener in the nose, the operator uses the device to press on the object to be fastened so that the spring is compressed. The energy imparted to the spring in compressing it is recovered by having this potential energy converted to kinetic energy to effect a resetting of the device. When the charge is ignited, the piston moves towards the nose and impacts the fastener, forcing it into the object to be fastened. As the operator lifts the device away from the object just fastened, to position the device for the next fastening operation, the force on the spring is released, allowing the stored energy in the spring to urge the nose/liner away from the piston and thereby reset the device. Preferably, the magazine of charges is advanced to load a new charge into the chamber for driving the next fastener.

Also in view of the foregoing, another object of this invention is to provide an improved device and method for advancing the strip of charges in a combustion-powered tool. More particularly, an object of this invention is to provide such an improved device and method that does not misalign and fail to advance the strip. Another object of the invention is to provide a combustion-activated tool having this improved device.

This invention provides a combustion-activated tool comprising (i) a housing having a longitudinal bore that extends to and connects with a vertical bore, (ii) a piston and piston guide disposed within the longitudinal bore and moveable axially therein, and (iii) an advance lever having a reset end and an advancing end, said lever disposed on a pivot skew to the axis of the longitudinal bore, the lever having an axis essentially parallel with the longitudinal bore, the advancing end of the lever attached on an arm of the lever angled to one side of the axis of the longitudinal bore and effective to engage teeth on the side of a strip of charges disposed in the vertical bore, the reset end of the lever being disposed on the same side of the axis of the longitudinal bore and engaging the piston guide.

In summary, the lever for advancing the strip of charges has one end that engages the piston guide and another than engages teeth or recesses on the strip of charges. The longitudinal and vertical bores are orthogonal to each other. Each of the charges on the strip is thus positioned, sequentially, at the intersection of the two bores. The advancing end of the lever is disposed to one side of the strip to engage the teeth thereon, and the reset end of the lever being disposed on the same side but at the position of the piston guide.

DESCRIPTION OF PREFERRED EMBODIMENTS

Figure 1:
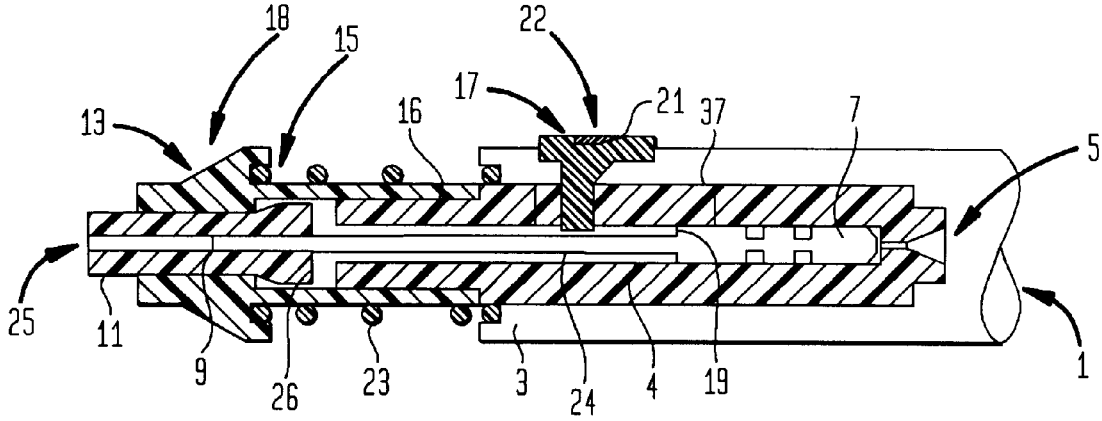
FIG. 1 depicts an idealized partial cross-section of the device ready to have a fastenered loaded into the nose, as well as after it has been operated and removed from the surface of the object just fastened.

FIG. 1 shows the device in idealized partial cross-section. The housing 1 portion shown has a bore in which a piston guide 3 or chamber is disposed; the bore defines the longitudinal axis, and the piston guide is slidable within the bore. The piston guide has its own bore 4. The nozzle portion 5 of the guide receives the combustion gases from the charge (not shown in this figure) and directs the gases to impact the combustion end of the piston 7. The ramming end 9 of the piston that impacts and drives the fastener is at the end of the piston opposite from the combusion end. The ramming end engages the bore of the baseplate 11 disposed in the nose 13 of the device. The nose can be a separate piece or integral with the liner 15 that engages an outer circumference 16 of the piston guide. The liner is an annulus that forms a bore in which the end of the guide opposite the nozzle is slidably received. Collectively, the nose, baseplate, and liner comprise the head 18 of the device. Travel of the piston within the bore of the guide is limited at one end by the nozzle. Extending from the housing, through the piston guide, and into the piston guide bore is a reset stop 17 that engages a rest 19 on the piston, as described more fully below. The reset stop has a notch 21 in its outer surface and a leaf spring 22 in the form of a ring disposed around the housing resides in the notch to maintain the location of the reset stop with respect to the housing. A coil or helical spring 23 is disposed coaxially with the liner and its two ends engage the head and the housing. The force of the spring 23 is normally to urge the head away from the housing. Although other means can be used for urging the head and housing apart (e.g., a leaf spring in the form of a bellows, a compressible material such as foam), a coil spring in the configuration shown is preferred. A fastener (e.g., a nail) is placed head first into the opening 25 of the baseplate. The head and the piston guide are shown as separate pieces; they are maintained fixed in their relative position by a locking ring (not shown); in other embodiments, these two parts can be integral, or may have multiple pieces fixed in relative position by well-known means.

The baseplate has a rear portion 26 that also acts as a stop, but in a different manner than the stop 17. If the device were to fire a fastener into a soft material, so that there is essentially no resistance to the forward direction of the piston, the rest 19 on the piston would hit the stop 17 and destroy the apparatus because of the forces. To limit the forward movement of the piston, the stop 26 engages a raised portion 24 on the piston; this raised portion has a diameter within the bore insufficient to engage the reset stop 17, but is larger than the bore in the baseplate and so is stopped thereby.

The article 27 to be attached to another article 29 (typically a structural surface such as a floor) is positioned as desired. The device is pressed to the article to be fastened so that the end of the baseplate with the opening is flush against the article to be fastened. When so pressed, the force of the spring is overcome and it is compressed, allowing the head and housing to approach each other, thereby decreasing the distance between the ram end of the piston and the head of the fastener so the ram will impact the fastener. That is, decreasing the distance from the head to the housing allows the piston to impact the fastener; otherwise, the piston will not reach the because its travel would be halted by the stop.

Figure 2A:
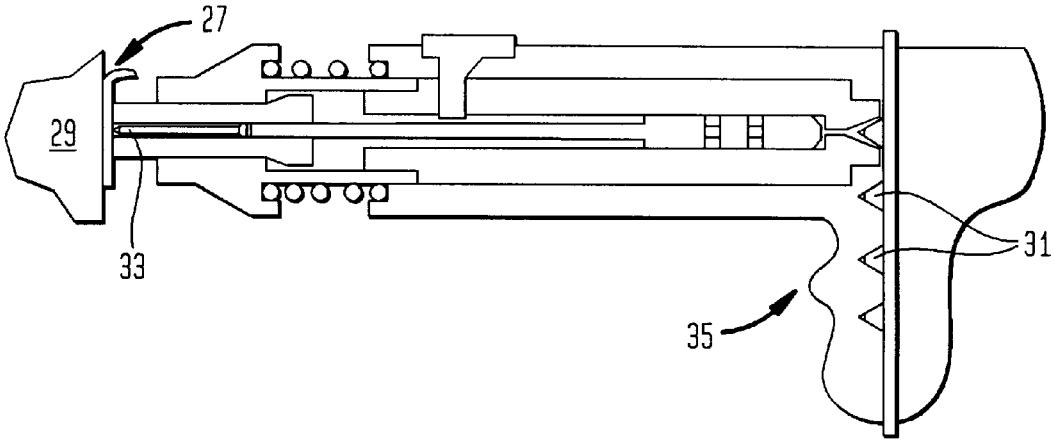
FIGS. 2*a*–2*c* depict an idealized partial cross-section of the device in the configuration in which it is pressed against the surface of the object to be fastened and is ready to drive a fastener (2*a*), in the same position after it has been fired and the fastener driven (2*b*), and after the device has been moved away from the object fastened (2*c*).
Figure 2B:
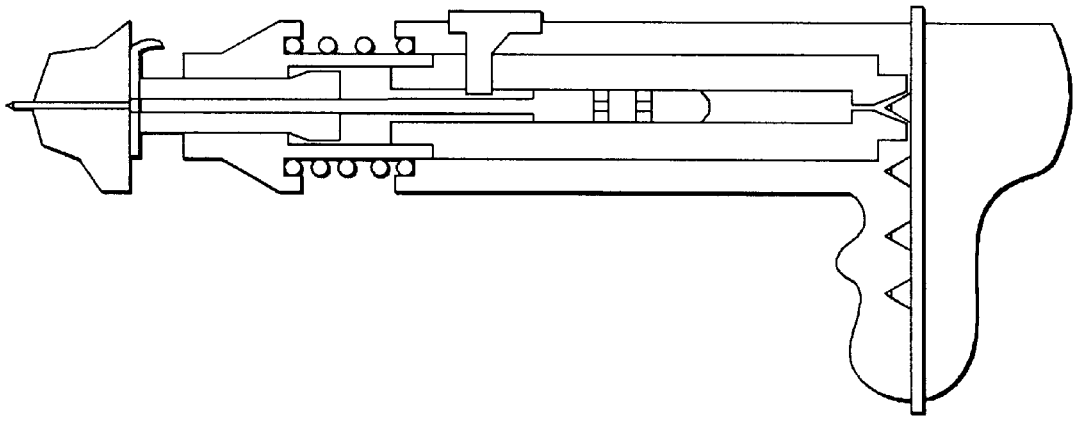
Figure 2C:
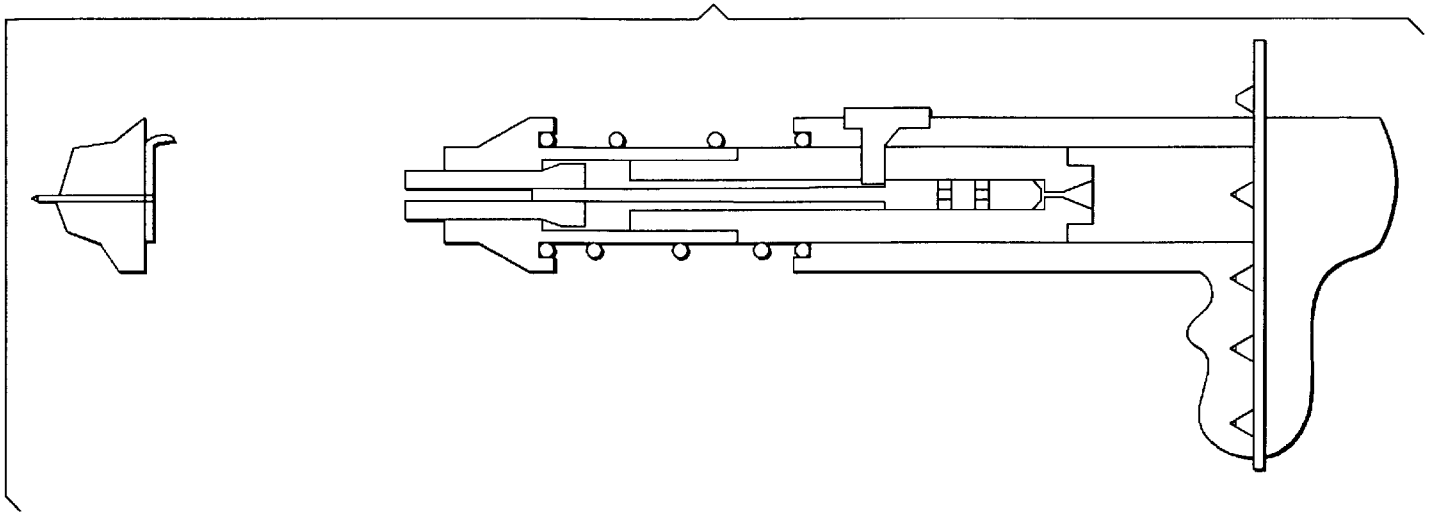

The configurations through which the device passes between each cycle are shown in FIG. 2. As shown (in 2*a*), when the device is ready to be fired, a charge 31 (preferably on a strip of charges mechanically advanced through well-known means) is disposed adjacent the nozzle opening in the piston guide, the piston is positioned to the back (i.e., opposite end from the nose) of the piston guide and adjacent the nozzle, and a fastener 33 is present in the head bore. The operator (of the device) presses the head of the device to the article 27 to be fastened and the surface of the object 29 to which the article is to be fastened. (The operator's weight should continuously press on the device to counter the recoil of the device when the charge is ignited.) When the-trigger 35 (not shown in detail) is actuated, the charge is ignited, creating combustion gases that are directed by the nozzle to the combustion end of the piston. As shown (in 2*b*), the piston is thus rammed into the head of the fastener, forcing the fastener through the article to be attached and into the article to which it is now attached. As the device is removed from the now-fastened article and the head disengages therefrom (in 2*c*), the operator's energy in compressing the spring is now released as the spring forces the combined head and piston guide to the front (i.e., head end) of the device. However, the reset stop 17 catches the piston in the guide and holds the piston at the reset stop's position while the remainder of the combined head and piston guide travel to the front of the device because of the spring. The combined head and guide travel to the front until the nozzle portion of the guide abuts the combustion end of the piston. The device is then in the configuration shown in FIG. 2*c*. As noted above, the reset stop passes through a groove in the combined head and piston guide. In the final configuration shown in FIG. 2*c*, the device is in a position where it is reset and ready to be fired again (after a fastener is inserted into the nosepiece). The work of the operator on the device to overcome the spring force and compress the spring is released as kinetic energy resetting the device. The spring should be chosen to have sufficient force to keep the device in the configuration shown in FIG. 2*c* even when-the device is pointed vertically and the weight of the combined head and piston guide would normally fall back to where the charges reside.

Figure 3:
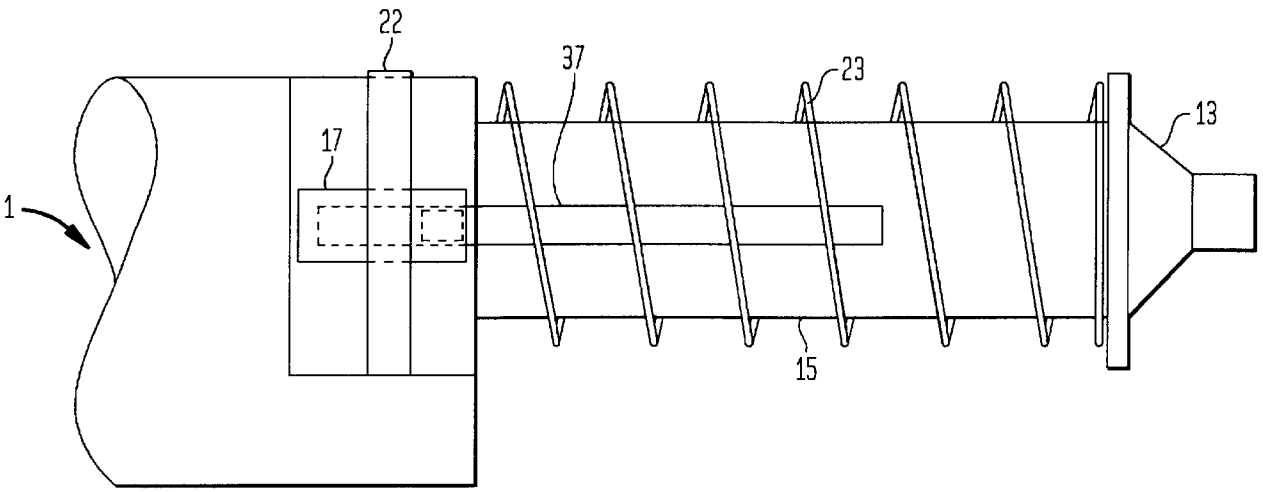
FIG. 3 depicts an idealized partial side view of the device shown in FIGS. 1 and 2.

FIG. 3 is an idealized partial side view of the device showing the groove or channel 37 through which the stop passes into the piston guide bore.

Certain aspects of the device which are well-known and do not form part of this invention are not described in detail or shown in the drawings. These include one or more safety mechanisms associated with the trigger to prevent accidental firing, and automatic advance of the strip of charges shown in the figures. Further, there is some play between the head and the piston guide.

Figure 4A:
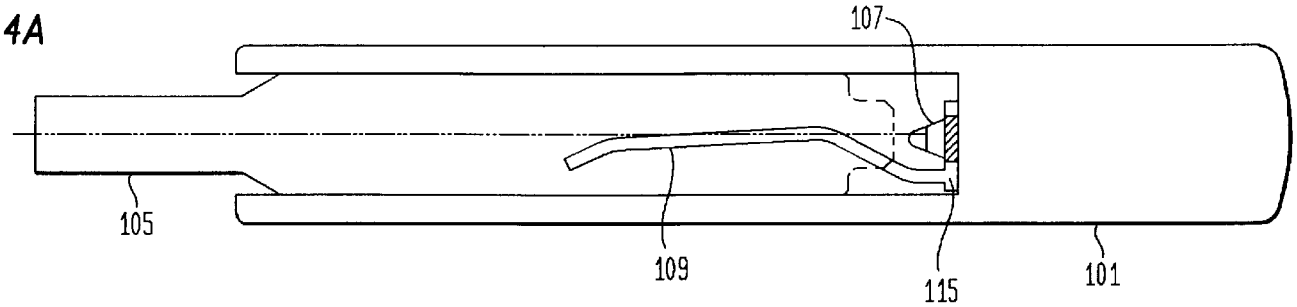
FIGS. 4A and 4B are idealized cutaway top and side views, respectively, of a combustion-actuated tool according to this invention.
Figure 4B:
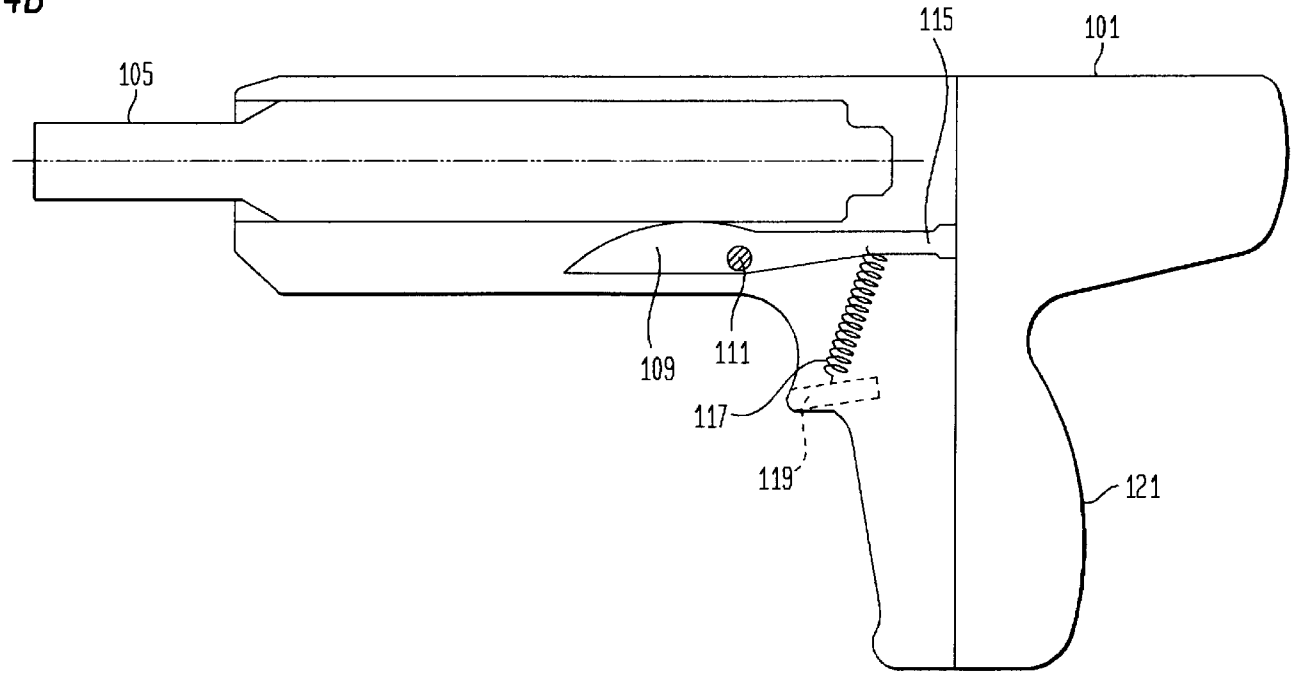
Figure 6:
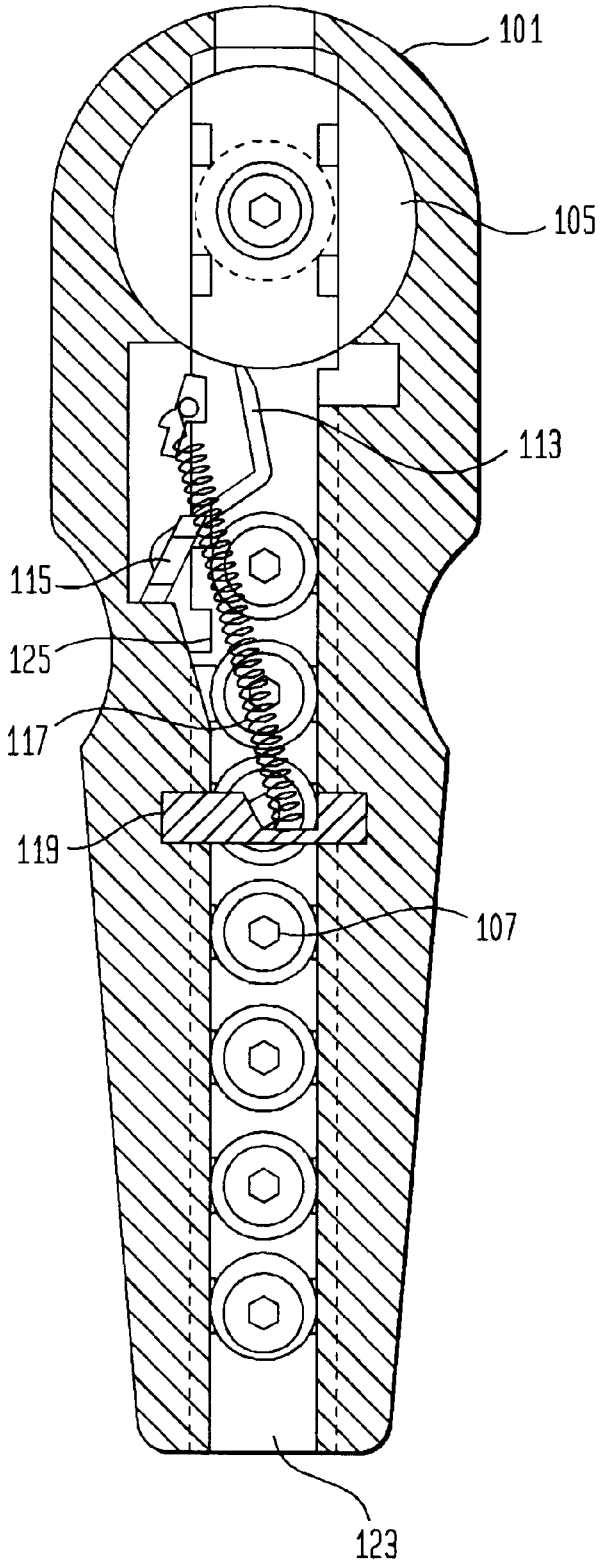
FIG. 6 is an idealized cutaway rear view of a combustion-actuated tool having a strip of charges to be advanced.

The combustion-actuated tool shown in FIGS. 4A and 4B includes a housing 101 with a longitudinal bore 103 in which is disposed a piston guide 105 (in which is disposed a piston, not shown). The piston guide moves in the longitudinal bore. In the position where the device is ready to be fired, the piston guide is disposed towards the rear of the tool (as shown in FIG. 4A) so that the rear portion of the guide is adjacent a charge 107. The charge is disposed on a strip (as shown in FIG. 6) that is advanced by a lever 109 disposed on a pivot 111 and having a reset end 113 and an advancing end 115 that is activated, in part, by a trigger 119 in the handle 121 of the tool. Such tools and methods for resetting the same are well known and are described, and preferably is that as described above.

As noted in the Background section, the charge is ignited to expel combustion gases effective to ram the piston and piston guide into a fastener disposed at the other end of the longitudinal bore, thereby driving the fastener into a workpiece. Thus, the piston and piston guide move in the longitudinal bore away from the charge, and when the tool is reset, they move in the opposite direction. As the piston guide moves away from the charge, the reset end of the lever moves into the bore previously occupied by the guide. When the tool is reset, the piston guide engages the reset end of the lever, forcing that end towards the handle and thus pivoting the advancing end towards the longitudinal bore. As shown in FIG. 6, a strip of charges is disposed in a vertical bore 123 through the handle of the tool. When the piston guide is reset, it is moved towards the handle and engages the reset end of the lever, causing it to pivot so that the advancing end of the lever engages a tooth 125 (or recess between teeth) on the strip of charges and moves the strip to position the next charge adjacent the end of the piston guide in the configuration shown in FIG. 4A. As shown in FIG. 6, both the advancing end and the reset end of the lever are disposed on the same side of the centerline ℄, the left side as shown in FIG. 6. By keeping the reset end of the lever on the same side as the advancing end, the advancing end is always forced back to the strip of charges. As described below, if the reset end were to reside on the other side of the centerline, the play in the pivot of the lever would force the advancing end of the lever away from the strip of charges.

Figure 5F:
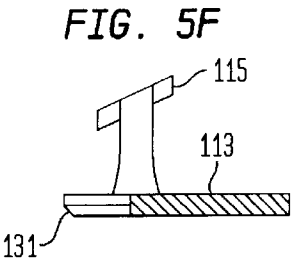
FIGS. 5A through 5F are, respectively, top, side, bottom, rear, and two cross-sectional (through lines E—E in FIG. 5C and F—F in FIG. 5A) views of levers according to this invention.
Figure 5D:
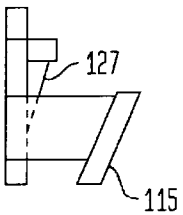
Figure 5E:
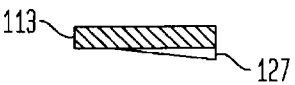
Figure 5A:
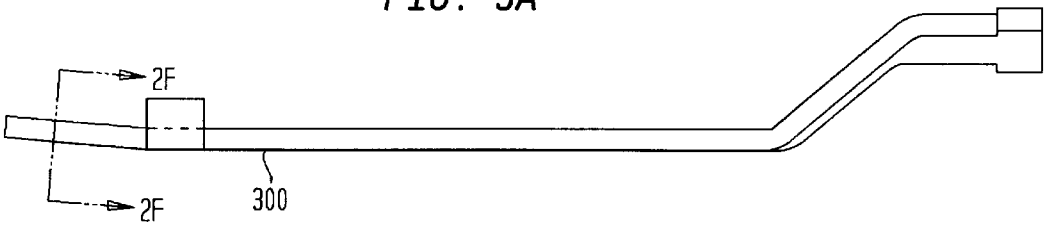
Figure 5B:
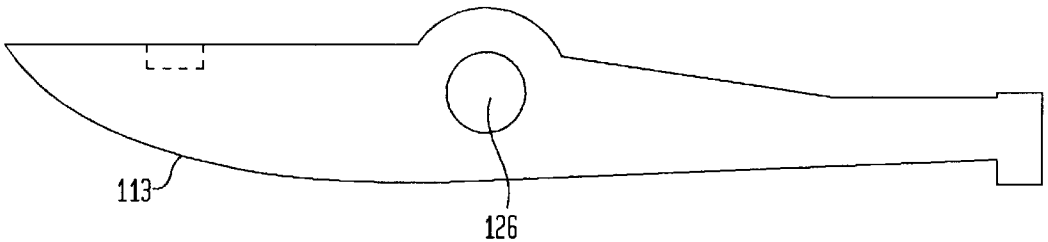
Figure 5C:
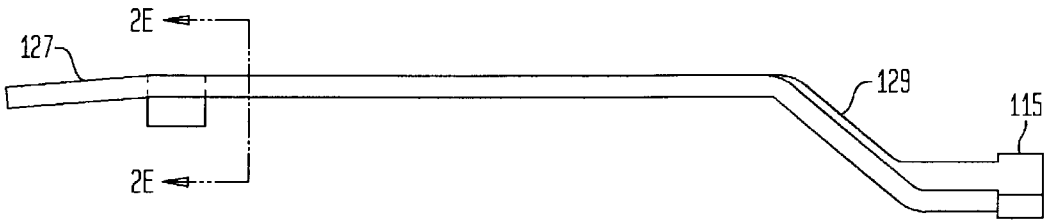

FIGS. 5A through 5E show various views embodiments of a lever useful for the present invention. The lever is mounted on the pivot through a hole 126 in the body of the lever. The reset end 113 has an angled portion 127. The advancing end 115 of the lever is disposed on an arm 129 that is also angled from the body of the lever. The angled portion and the arm are disposed on the same side of the body of the lever. In a most preferred embodiment, shown in FIG. 5F taken along line F—F in FIG. 5A, the edge of the lever has a bevel or knife edge 131 opposite the side to which the angled portion 127 is angled.

Figure 7A:
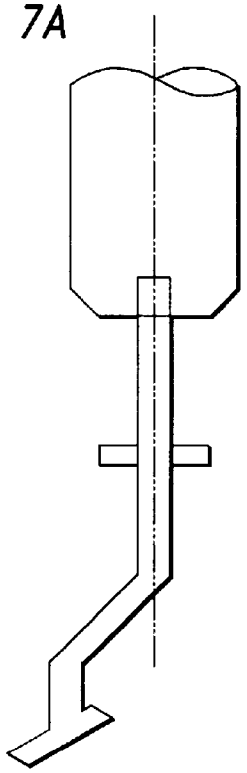
FIGS. 7A through 7D are idealized views showing the interaction between the lever and the piston guide.
Figure 7B:
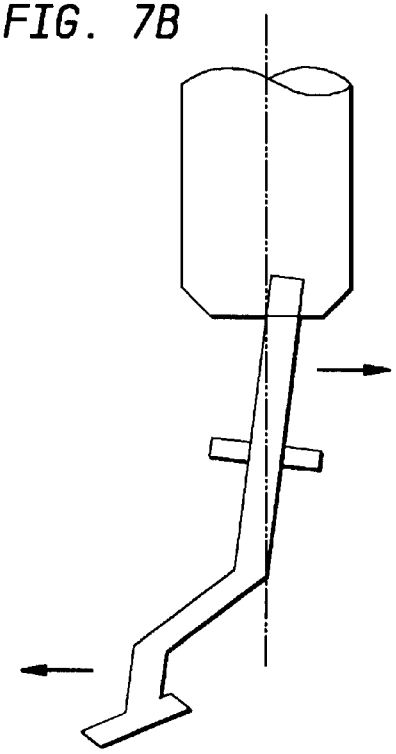
Figure 7C:
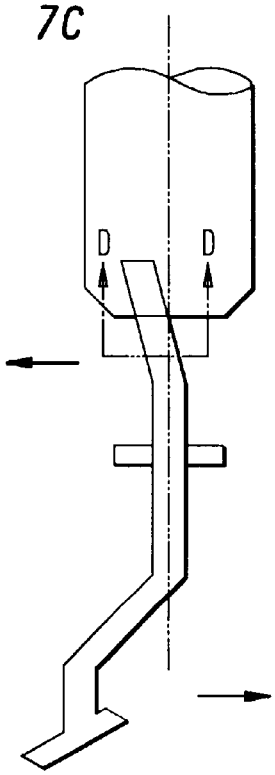
Figure 7D:
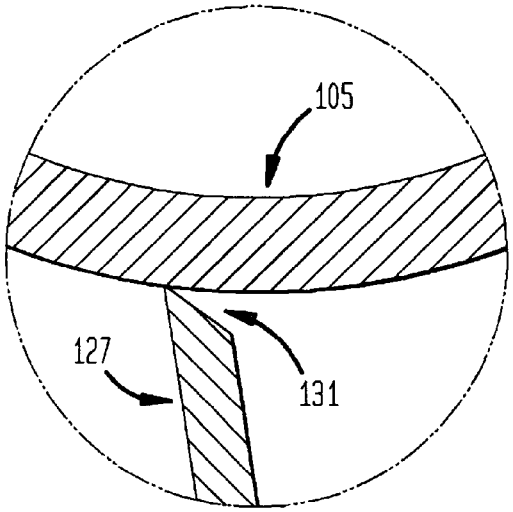

The import of the present invention is seen in FIGS. 7A through 7C. FIG. 7A shows an idealized top (or bottom) view of the lever disposed on the pivot where the reset end of the lever engages the piston guide. In the prior art construction shown in FIGS. 7A and 7B, it can be seen that the reset end of the lever can align on the center line of the longitudinal bore, essentially along the axis of the piston guide. In this position, because the piston guide is ground (annular), the reset end of the lever will engage the piston guide on one side of the center line or the other, perhaps randomly, as the lever pivots because no force maintains the lever in a desired position. As shown in FIG. 7B, if the reset end of the lever rides on the side of the center line opposite from that on which the advancing end is disposed (as shown by the upper arrow), the advancing end will be forced in the other direction (the direction of the lower arrow), so that the advancing end will be forced away from the strip of charges and will not engage the teeth on the strip and so will not advance the strip. FIG. 7C shows the lever of the present invention. The angled portion of the reset end is designed to stay on one side of the center line, so that when the lever engages the piston guide the reset portion is forced in the direction of the adjacent arrow. This forces causes the advancing end to be forced towards the strip of charges (in the direction of the arrow adjacent that end). By providing a lever having the advancing end and the reset end disposed on the same side of the body of the lever, the advancing end will not misalign but will always be forced into the strip of charges. FIG. 7D is a close-up cross-sectional view along line D—D in FIG. 7C showing the interaction of the bevelled edge 131 with the perimeter of the piston guide 105. In this figure, the advantage of the bevelled edge can be seen to facilitate maintaining the reset end on the proper side (here the left side) of the center line.

Of course, a preferred tool has the features of both automatic resetting and of the level mechanism for advancing the charges.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A device for driving a fastener, comprising:

a housing having a first bore;

a piston and a piston guide disposed in the first bore, said piston having a combustion end and a ramming end;

a combustion chamber disposed adjacent the combustion end of the piston;

a reset stop disposed in the first bore for limiting travel of the piston within the first bore away from the combustion chamber, the reset stop being in a fixed position with respect to the housing;

a head portion having a second bore coaxial with the first bore, one end of the second bore adapted to receive the ramming end of the piston, and the other end of the bore adapted to receive a fastener to be impacted by the ramming end of the piston, the head and the housing being slidably engageable along the axis of the first and second bores; and a spring disposed between and urging the head and the housing apart along the axis of the bores;

the first bore extending to and connecting with a vertical bore; and an advance lever having a reset end and an advancing end, said lever disposed on a pivot orthogonal skew to the axis of the first bore, the lever having an axis essentially parallel with the longitudinal bore, the advancing end of the lever attached on an arm of the lever angled to one side of the axis of the longitudinal bore and effective to engage teeth on the side of a strip of charges disposed in the vertical bore, the reset end of the lever being disposed on the same side of the axis of the longitudinal bore and engaging the piston guide along an edge of the lever.

2. The device of claim 1, further comprising a magazine of charges and means for automatically loading a charge from the magazine into operating relationship with the combustion chamber.

3. The device of claim 1, further comprising a magazine of fasteners and means for automatically loading a fastener from the magazine into the second bore.

4. The device of claim 1, further comprising a trigger disposed in the housing, the trigger being connected to the lever by a spring.

5. The tool of claim 1, wherein the edge of the lever engaging the piston guide has a bevel.

6. A device for driving a fastener with combustion gases and having an automatic reset, comprising:

a housing having a first bore, means for accepting a charge, and a trigger for igniting the charge;

a slidable guide having a second bore coaxial with the first bore, the guide being disposed in the first bore, one end of the bore having a nozzle for receiving and directing combustion gases from the charge;

a piston disposed in the second bore and having a combustion end disposed towards the nozzle and an opposite ramming end;

a head portion having a third bore coaxial with the first and second bores, the third bore adapted to receive a fastener to be driven and to receive the ramming end of the piston to drive the fastener, the head portion and slidable guide being joined to each other;

means for urging the joined head portion and slidable guide away from the housing;

a reset stop in the second bore for limiting the travel of the piston towards the head portion, the reset stop having a fixed position with respect to the housing;

the first bore extending to and connecting with a vertical bore; and an advance lever having a reset end and an advancing end, said lever disposed on a pivot orthogonal skew to the axis of the first bore, the lever having an axis essentially parallel with the longitudinal bore, the advancing end of the lever attached on an arm of the lever angled to one side of the axis of the longitudinal bore and effective to engage teeth on the side of a strip of charges disposed in the vertical bore, the reset end of the lever being disposed on the same side of the axis of the longitudinal bore and engaging the piston guide along an edge of the lever.

7. The device of claim 6, further comprising a magazine of charges and means for automatically loading a charge from the magazine into operating relationship with the combustion chamber.

8. The device of claim 6, further comprising a magazine of fasteners and means for automatically loading a fastener from the magazine into the second bore.

9. The device of claim 6, wherein the ramming end of the piston comprises a portion having a diameter greater than the third bore.

10. A method for automatically resetting a device for driving fasteners, comprising:

providing a device for driving fasteners, which device comprises:

a housing having a first bore, means for accepting a charge, and a trigger for igniting the charge;

a slidable guide having a second bore coaxial with the first bore, the guide being disposed in the first bore, one end of the bore having a nozzle for directing combustion gases from the charge;

a piston disposed in the second bore and having a combustion end disposed towards the nozzle and an opposite ramming end;

a head portion having a third bore coaxial with the first and second bores, the third bore adapted to receive a fastener to be driven and to receive the ramming end of the piston to drive the fastener, the head portion and slidable guide being joined to each other;

means for urging the joined head portion and slidable guide away from the housing;

a reset stop in the second bore for limiting the travel of the piston towards the head portion;

the first bore extending to and connecting with a vertical bore; and an advance lever having a reset end and an advancing end, said lever disposed on a pivot orthogonal skew to the axis of the first bore, the lever having an axis essentially parallel with the longitudinal bore, the advancing end of the lever attached on an arm of the lever angled to one side of the axis of the longitudinal bore and effective to engage teeth on the side of a strip of charges disposed in the vertical bore, the reset end of the lever being disposed on the same side of the axis of the longitudinal bore and engaging the piston guide along an edge of the lever; and a spring for pivoting the lever;

said method comprising: providing a strip of at least two charges in the vertical bore so that one charge is in the nozzle, said strip having teeth adapted to be engaged by the advance lever; providing a fastener in the third bore;

providing an object and an article to be attached thereto;

positioning the article on the object in an orientation suitable for attachment;

positioning the head portion of the device abutting the article;

pressing the device towards and onto the article effective to overcome the means for urging the joined head portion and slidable guide away from the housing and thereby move the same towards the charge;

engaging the trigger to activate the charge, whereby combustion gases from the charge are channelled through the nozzle and force the piston to impact and drive the fastener through the article and into the object;

removing the device from the article whereby said means urges the joined head portion and slidable guide away from the housing and whereby said reset stop limits movement of the piston in the joined head portion and slidable guide in the direction of the head as it moves away from the housing, effective to dispose the combustion end of the piston adjacent the nozzle; and pivoting the lever via said spring to advance said strip of charges.

11. The method of claim 10, wherein the device provided further comprises a magazine of charges and means for automatically loading a charge from the magazine into operating relationship with the combustion chamber, and wherein the charge is automatically loaded when the device is reset.

12. The method of claim 10, wherein the device provided further comprises a magazine of fasteners and means for automatically loading a fastener from the magazine into the second bore, and wherein a fastener is automatically loaded into the third bore when the device is reset.

* * * * *